US010770224B2

(12) United States Patent
Kamachi et al.

(10) Patent No.: US 10,770,224 B2
(45) Date of Patent: Sep. 8, 2020

(54) METHOD FOR FORMING ELECTROLYTIC COPPER PLATING FILM ON SURFACE OF RARE EARTH METAL-BASED PERMANENT MAGNET

(71) Applicant: Hitachi Metals, Ltd., Tokyo (JP)

(72) Inventors: Masanao Kamachi, Kumagaya (JP); Koshi Yoshimura, Yabu (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/020,650

(22) Filed: Jun. 27, 2018

(65) Prior Publication Data

US 2018/0350519 A1 Dec. 6, 2018

Related U.S. Application Data

(62) Division of application No. 13/825,055, filed as application No. PCT/JP2011/072366 on Sep. 29, 2011, now abandoned.

(30) Foreign Application Priority Data

Sep. 30, 2010 (JP) ..... 2010-222144

(51) Int. Cl.
*C25D 3/38* (2006.01)
*H01F 41/02* (2006.01)
(Continued)

(52) U.S. Cl.
CPC ..... *H01F 41/026* (2013.01); *C25D 3/38* (2013.01); *C25D 7/001* (2013.01); *H01F 7/0221* (2013.01); *H01F 41/26* (2013.01)

(58) Field of Classification Search
CPC ..... C25D 3/38
(Continued)

(56) References Cited

U.S. PATENT DOCUMENTS

2003/0136471 A1 7/2003 Kikugawa et al.
2005/0028890 A1* 2/2005 Sakaki ..... H01F 1/0557 148/105
(Continued)

FOREIGN PATENT DOCUMENTS

CN 101023205 A 8/2007
CN 101405435 A 4/2009
(Continued)

OTHER PUBLICATIONS

Oyamada et al., "Effectiveness of Stepwise Current Wave Form in USLI Copper Electroplating," Journal of the Japan Institute of Electronics Packaging (2002), vol. 5, No. 1, pp. 79-81. (Year: 2002).*
(Continued)

*Primary Examiner* — Edna Wong
(74) *Attorney, Agent, or Firm* — Kratz, Quintos & Hanson, LLP

(57) ABSTRACT

An object of the present invention is to provide a novel method for forming an electrolytic copper plating film having excellent adhesion on the surface of a rare earth metal-based permanent magnet. The method of the present invention as a means for achieving the object is characterized in that after a magnet is immersed in a plating solution, a cathode current density of 0.05 A/dm$^2$ to 4.0 A/dm$^2$ for performing an electrolytic copper plating treatment is applied thereto over 10 seconds to 180 seconds to start the treatment.

4 Claims, 5 Drawing Sheets

(51) Int. Cl.

| | |
|---|---|
| ***H01F 7/02*** | (2006.01) |
| ***C25D 7/00*** | (2006.01) |
| *H01F 41/26* | (2006.01) |

(58) Field of Classification Search
USPC ..... 205/291, 295
See application file for complete search history.

(56) References Cited

U.S. PATENT DOCUMENTS

| | | | |
|---|---|---|---|
| 2006/0213778 | A1 | 9/2006 | Cheng et al. |
| 2007/0269679 | A1 | 11/2007 | Niinae |
| 2008/0053573 | A1 | 3/2008 | Sakamoto et al. |
| 2008/0202642 | A1 | 8/2008 | Sakamoto et al. |
| 2009/0035603 | A1 | 2/2009 | Niinae |

FOREIGN PATENT DOCUMENTS

| | | | | | |
|---|---|---|---|---|---|
| JP | 2002105690 | A | | 4/2002 | |
| JP | 2002126642 | A | | 5/2002 | |
| JP | 2003100536 | A | | 4/2003 | |
| JP | 2006219696 | A | * | 8/2006 | ..... C25D 3/38 |
| JP | 2008031536 | A | | 2/2008 | |

OTHER PUBLICATIONS

Oyamada et al., "Via-Filling by Copper Electroplating Using Stepwise Current Control," Electrochemistry (Tokyo, Japan) [2006], vol. 74, No. 3, pp. 212-215. Abstract only. (Year: 2006).*

Extended European Search Report Issued by the European Patent Office dated Nov. 23, 2017, in copending European Patent Application No. 11829270.5 (8 pages).

Office Action dated Mar. 13, 2015, in counterpart CN application 201180047128.8.

International Search Report for International Application No. PCT/JP2011/072366 dated Jan. 10, 2012.

* cited by examiner

[Fig. 1]
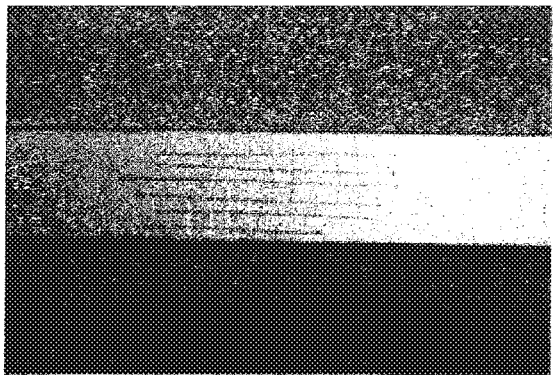
[Fig. 2]
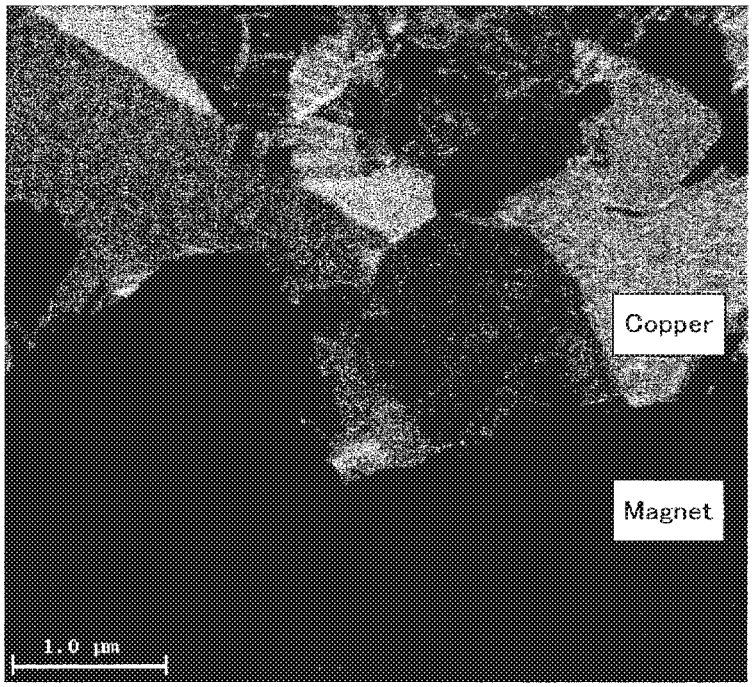

[Fig. 3]
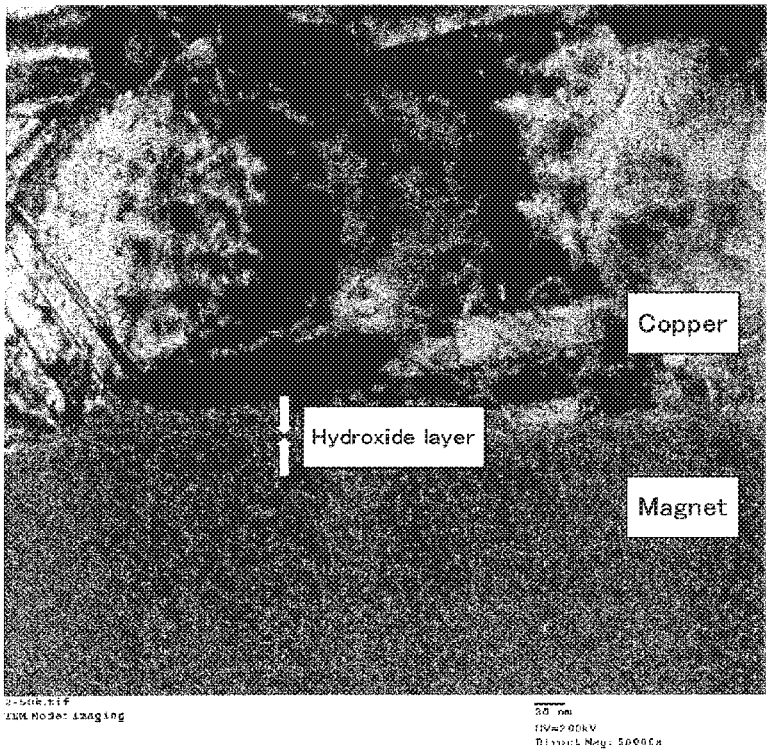
[Fig. 4]
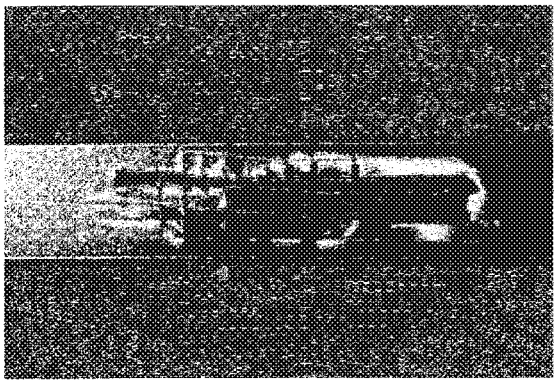

[Fig. 5]
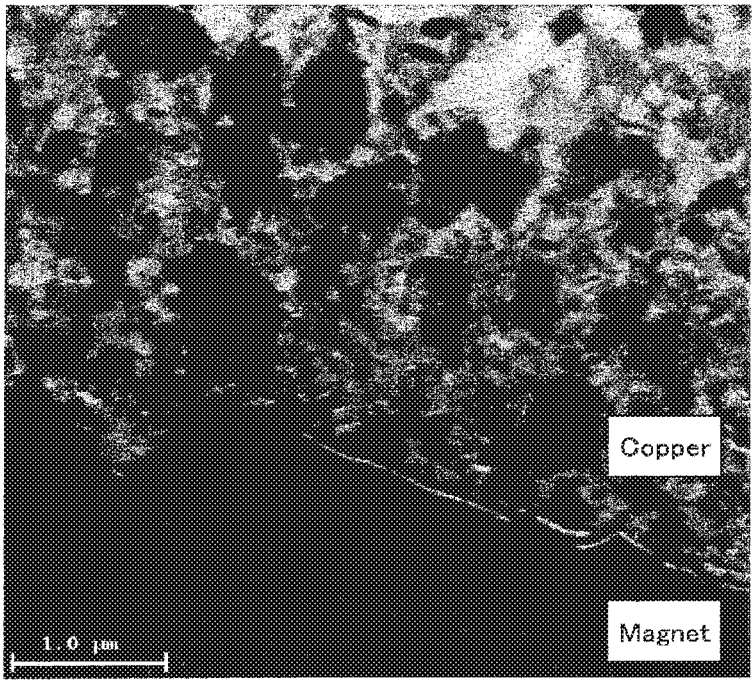
[Fig. 6]
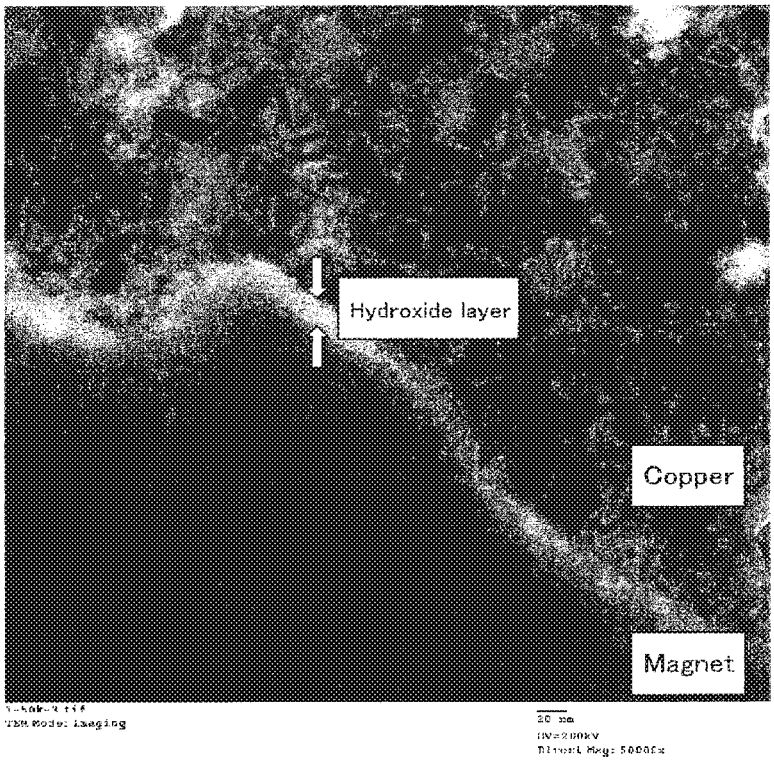

[Fig. 7]
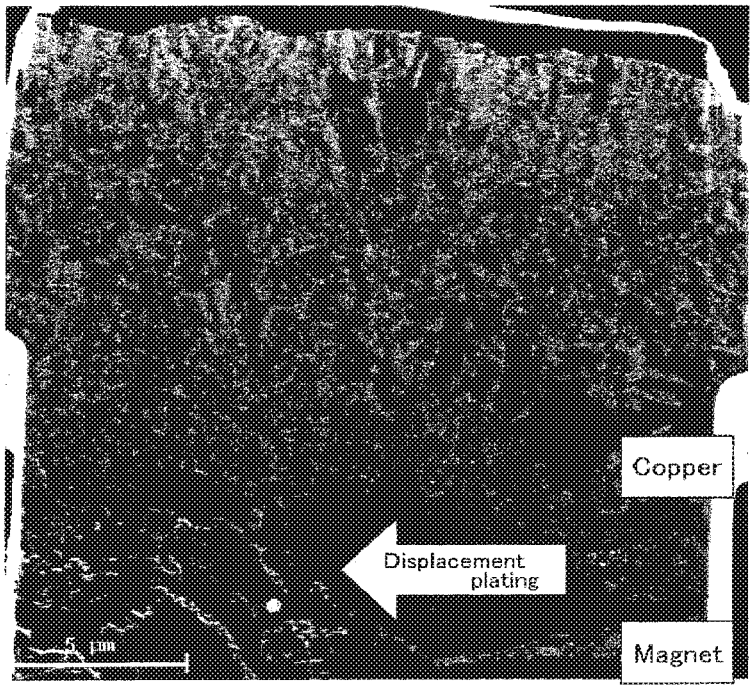
[Fig. 8]
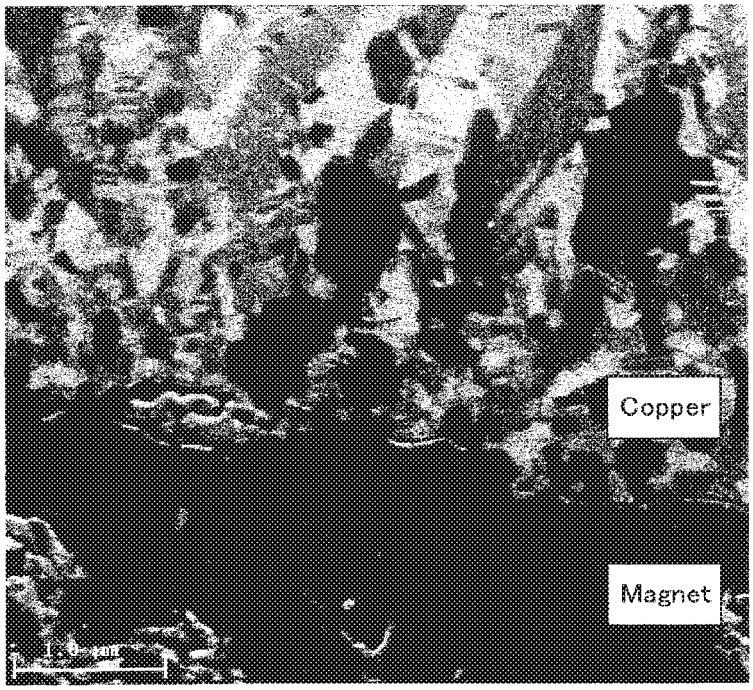

[Fig. 9]
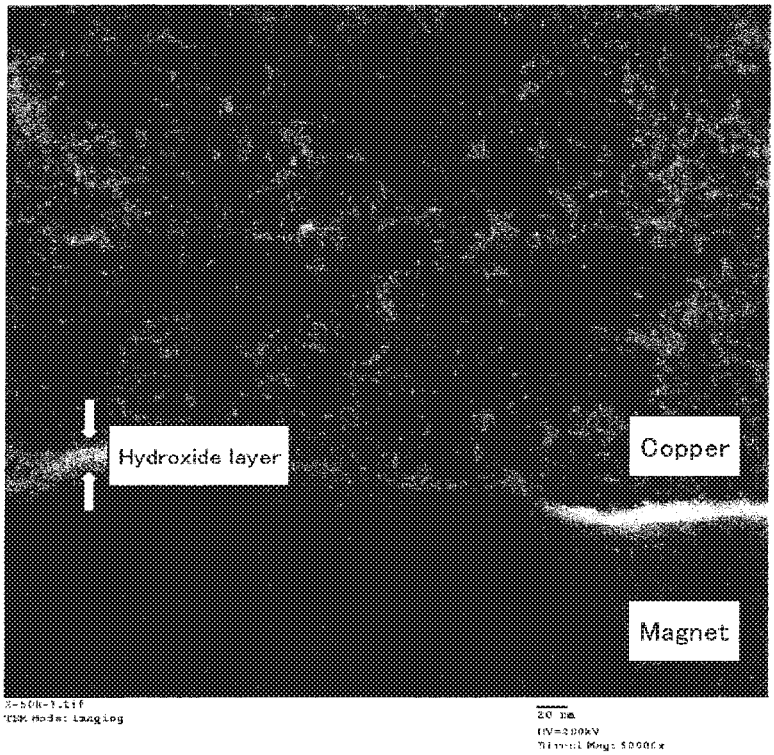
[Fig. 10]
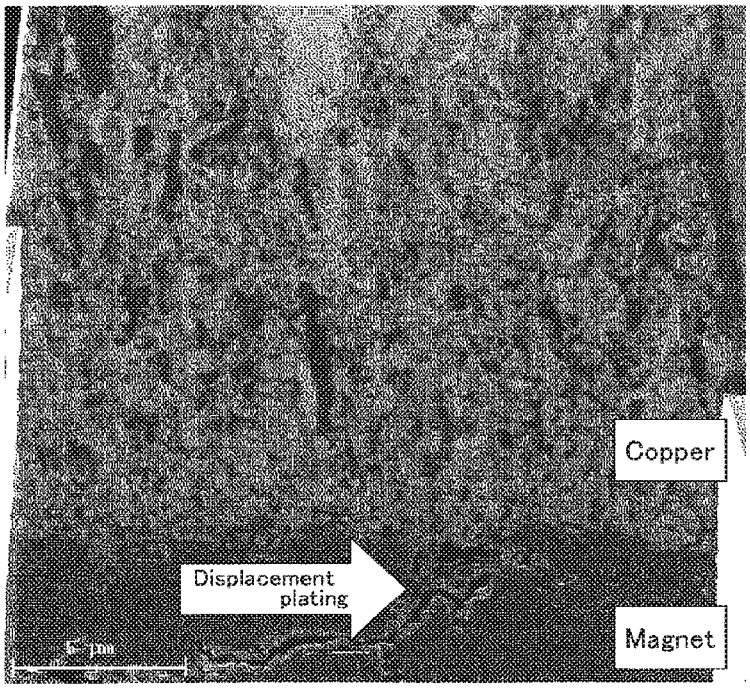

METHOD FOR FORMING ELECTROLYTIC COPPER PLATING FILM ON SURFACE OF RARE EARTH METAL-BASED PERMANENT MAGNET

TECHNICAL FIELD

The present invention relates to a novel method for forming an electrolytic copper plating film having excellent adhesion on the surface of a rare earth metal-based permanent magnet.

BACKGROUND ART

Rare earth metal-based permanent magnets, such as R—Fe—B based permanent magnets, have high magnetic characteristics and thus are used in various fields today. However, rare earth metal-based permanent magnets contain a highly reactive rare earth element: R and thus are susceptible to oxidation corrosion in the air. Therefore, in the case where they are used without any surface treatment, corrosion proceeds from the surface due to the presence of a small amount of acid, alkali, moisture, or the like, whereby rusting occurs, causing deterioration or fluctuation in magnetic characteristics. Further, in the case where such a rusted magnet is incorporated into a device such as a magnetic circuit, the rust may be dispersed and contaminate peripheral parts. In light of the above points, methods for forming a copper plating film on the surface of a rare earth metal-based permanent magnet as a film having excellent corrosion resistance have been employed in the past.

Generally, methods for forming a copper plating film are roughly divided into an electrolytic copper plating treatment and a non-electrolytic copper plating treatment. In the case where a non-electrolytic copper plating treatment is used to form a copper plating film on the surface of a rare earth metal-based permanent magnet, the rare earth element or iron, which is a constituent element of the magnet, may eluted into the plating solution and reacts with a reducing agent contained in the plating solution, promoting the formation of a copper plating film on the surface of the rare earth element or iron eluted into the placing solution; in order to prevent such a problem, it is important to control the plating solution, but this is not always easy. In addition, a plating solution for a non-electrolytic copper plating treatment is generally expensive. Therefore, in the formation of a copper plating film on the surface of a rare earth metal-based permanent magnet, a simple and low-cost electrolytic copper plating treatment is usually employed.

Various methods for forming an electrolytic copper plating film on the surface of a rare earth metal-based permanent magnet have been proposed in the past. The research group of the present inventors has also proposed, for example, in Patent Document 1, a method for forming an electrolytic copper plating film on the surface of a rare earth metal-based permanent magnet using an alkaline plating solution containing $Cu^{2+}$ ions for an electrolytic copper plating treatment. The plating solution has blended therein, as a chelating agent having a high chelate stability constant with $Cu^{2+}$ ions, an organic phosphoric acid having two or more phosphorus atoms, such as 1-hydroxyethylidene-1,1-diphosphonic acid (HEDP), or a salt thereof and, as chelating agent having a high chelate stability constant with Fe ions, gluconic acid or a salt thereof. They have also proposed, in Patent Document 2, a method for forming an electrolytic copper plating film on the surface of a rare earth metal-based permanent magnet using an alkaline plating solution containing $Cu^{2+}$ ions for an electrolytic copper plating treatment. The plating solution has blended therein a chelating agent having a predetermined chelate stability constant with $Cu^{2+}$ ions (HEDP, a salt thereof, etc.) and a chelating agent having a predetermined chelate stability constant with $Fe^{3+}$ ions (pyrophosphoric acid, a salt thereof, etc.) under a predetermined alkaline condition. In addition, it is also possible to form an electrolytic copper plating film on the surface of a rare earth metal-based permanent magnet using a commercially available plating solution for an electrolytic copper plating treatment. However, with the recent expansion of the application field of rare earth metal-based permanent magnets, there is a demand for an improved method for forming an electrolytic copper plating film on the surface of a rare earth metal-based permanent magnet, for example, a method for forming an electrolytic copper plating film having improved adhesion.

PRIOR ART DOCUMENTS

Patent Documents

Patent Document 1: Japanese Patent No. 4033241
Patent Document 2: Japanese Patent No. 3972111

SUMMARY OF THE INVENTION

Problems that the Invention is to Solve

Thus, an object of the present invention is to provide a novel method for forming an electrolytic copper plating film having excellent adhesion on the surface of a rare earth metal-based permanent magnet.

Means for Solving the Problems

In order to achieve the above object, first, the present inventors have examined possible reasons why it is difficult to form an electrolytic copper plating film having ideal adhesion by methods for forming an electrolytic copper plating film on the surface of a rare earth metal-based permanent magnet proposed in the past. As a result, they have come to think that the environment near the surface of a rare earth metal-based permanent magnet immersed in a plating solution for performing an electrolytic copper plating treatment of the magnet may be associated with whether the adhesion of an electrolytic copper plating film formed on the surface of the magnet is good or bad. Specifically, in the case where a rare earth metal-based permanent magnet is subjected to an electrolytic copper plating treatment, usually, as the preceding process, there is a water washing process for washing the surface of the magnet. Thus, the magnet is immersed in a plating solution with the surface thereof being somewhat covered with water used in the water washing process. Immediately after the magnet is immersed in the plating solution, a predetermined cathode current density (e.g., 0.05 $A/dm^2$ to 4.0 $A/dm^2$) for performing an electrolytic copper plating treatment is applied to start the treatment. In this case, while $Cu^{2+}$ ions contained in the plating solution have not spread over the area near the surface of the magnet due to the presence of water covering the surface of the magnet, the high cathode current density as above is immediately applied to start the treatment. Then, because of the evolution of hydrogen resulting from the electrolysis of water near the surface of the magnet, etc., a displacement plating reaction takes place between an electrochemically base metal constituting the surface of the magnet, such as iron, and copper which is an electrochemically noble metal. Accordingly, the displacement deposition of copper on the surface of the magnet or the excessive formation of an oxygen-containing layer made of hydroxide of iron, which is a constituent element of the magnet, or the like on the surface of the magnet cannot be sufficiently prevented. As a result, these factors that adversely affect the adhesion of a film are elicited. The present inventors have come to think that this may be the cause of the formation of an electrolytic copper plating film that does not have predetermined adhesion on the surface of a magnet. On such a hypothesis, the present inventors have conducted extensive research on a method capable of improving, at the start of an electrolytic copper plating treatment of a rare earth metal-based permanent magnet, the environment near the surface of the magnet immersed in a plating solution. As a result, they have found that in order to solve the problems, it is effective to control the period of time necessary to apply the predetermined cathode current density for performing an electrolytic copper plating treatment at the start of the treatment.

A method for forming an electrolytic copper plating film on the surface of a rare earth metal-based permanent magnet according to the present invention accomplished based on the above findings is, as defined in a first embodiment, characterized in that after a magnet is immersed in a plating solution, a cathode current density of 0.05 $A/dm^2$ to 4.0 $A/dm^2$ for performing an electrolytic copper plating treatment is applied thereto over 10 seconds to 180 seconds to start the treatment.

A method as defined in a second embodiment is characterized in that in the method of the first embodiment, the electrolytic copper plating treatment is performed for a period of time of 2 minutes to 450 minutes.

A method as defined in a third embodiment is characterized in that in the method of the first embodiment, the plating solution is alkaline.

Further, a rare earth metal-based permanent magnet having an electrolytic copper plating film formed on the surface thereof according to the present invention is, as defined in a fourth embodiment, characterized in that an oxygen-containing layer that is present at the interface between the magnet and the film has a thickness up to 10 nm, and the film has an average crystal grain size of 0.5 μm to 3.0 μm.

A magnet as defined in a fifth embodiment is characterized in that in the magnet of the fourth embodiment, the film has a thickness of 2 μm to 20 μm.

A magnet as defined in a sixth embodiment is characterized in that in the magnet of the fourth embodiment, the electrolytic copper plating film is formed by the method of the first embodiment.

Further, a method for improving the adhesion of an electrolytic copper plating film formed on the surface of a rare earth metal-based permanent magnet according to the present invention is, as defined in a seventh embodiment, characterized in that after a magnet is immersed in a plating solution, a cathode current density of 0.05 $A/dm^2$ to 4.0 $A/dm^2$ for performing an electrolytic copper plating treatment is applied thereto over 10 seconds to 180 seconds to start the treatment.

Effect of the Invention

The present invention enables the provision of a novel method for forming an electrolytic copper plating film having excellent adhesion on the surface of a rare earth metal-based permanent magnet.

BRIEF DESCRIPTION OF THE DRAWINGS

FIG. 1 shows the result of a cross-cut peel test on a magnet test piece having an electrolytic copper plating film formed on the surface thereof in Example 1.

FIG. 2 shows the result of a cross-sectional analysis thereof (the analysis of the crystal grain size of the film).

FIG. 3 shows the result of a cross-sectional analysis thereof (the analysis of an oxygen-containing layer present at the interface between the magnet test piece and the film).

FIG. 4 shows the result of a cross-cut peel test on a magnet test piece having an electrolytic copper plating film formed on the surface thereof in Comparative Example 1.

FIG. 5 shows the result of a cross-sectional analysis thereof (the analysis of the crystal grain size of the film).

FIG. 6 shows the result of a cross-sectional analysis thereof (the analysis of an oxygen-containing layer present at the interface between the magnet test piece and the film).

FIG. 7 shows the result of a cross-sectional analysis thereof (the analysis of shedding observed at the interface between the magnet test piece and the film).

FIG. 8 shows the result of a cross-sectional analysis of a magnet test piece having an electrolytic copper plating film formed on the surface thereof an Comparative Example 2 (the analysis of the crystal grain size of the film).

FIG. 9 shows the result of a cross-sectional analysis thereof (the analysis of an oxygen-containing layer present at the interface between the magnet test piece and the film).

FIG. 10 shows the result of a cross-sectional analysis thereof (the analysis of shedding observed at the interface between the magnet test piece and the film).

MODE FOR CARRYING OUT THE INVENTION

The method for forming an electrolytic copper plating film on the surface of a rare earth metal-based permanent magnet of the present invention is characterized in that after a magnet is immersed in a plating solution, a cathode current density of 0.05 $A/dm^2$ to 4.0 $A/dm^2$ for performing an electrolytic copper plating treatment is applied thereto over 10 seconds to 180 seconds to start the treatment. After a magnet is immersed in a plating solution, the method does not immediately apply a high cathode current density for performing an electrolytic copper plating treatment to start the treatment, but applies a cathode current density such that a predetermined value is reached over a certain period of time to start the treatment. Accordingly, it is likely that even in the case where water used in the preceding water washing process is present on the surface of the magnet, and thus the amount of $Cu^{2+}$ ions present near the surface of the magnet is small, an appropriate electrodeposition reaction takes place because of the gradual application of the cathode current density, whereby the displacement deposition of copper on the surface of the magnet or the excessive formation of an oxygen-containing layer is effectively prevented. As a result, an electrolytic copper plating film having excellent adhesion can be formed on the surface of the magnet.

The reason why the cathode current density for performing an electrolytic copper plating treatment is specified as 0.05 $A/dm^2$ to 4.0 $A/dm^2$ in the present invention is as follows. A density of less than 0.05 $A/dm^2$ leads to low film formation efficiency, and the plating deposition potential may not be reached in some cases, whereby no film is formed. Meanwhile, a density of more than 4.0 A/dm$^2$ leads to the vigorous evolution of hydrogen, and the surface of the formed electrolytic copper plating film may be pitted or burned. Incidentally, the cathode current density is preferably 0.1 A/dm$^2$ to 3.0 A/dm$^2$, and more preferably 0.2 A/dm$^2$ to 1.0 A/dm$^2$.

The reason why the period of time necessary to apply the cathode current density for performing an electrolytic copper plating treatment is specified as 10 seconds to 180 seconds in the present invention is as follows. When the period of time is less than 10 seconds, the effect of gradual application is not exhibited, and this may cause the displacement deposition of copper on the surface of the magnet or the excessive formation of an oxygen-containing layer. Meanwhile, when the period of time is more than 180 seconds, the electrodeposition reaction of $Cu^{2+}$ ions contained in the plating solution does not proceed smoothly, and this may also cause the displacement deposition of copper on the surface of the magnet or the excessive formation of an oxygen-containing layer. Incidentally, the period of time necessary to apply the cathode current density for performing an electrolytic copper plating treatment is preferably 20 seconds to 100 seconds. The cathode current density may be applied, for example, by increasing the supply of current linearly or stepwise to reach the predetermined cathode current density within the predetermined period of time. In these cases, the cathode current density increase rate is preferably 0.002 A/(dm$^2$×sec) to 0.4 A/(dm$^2$×sec), and more preferably 0.01 A/(dm$^2$×sec) to 0.1 A/(dm$^2$×sec). At the start of an electrolytic copper plating treatment, it is preferable that no cathode current density is applied at the time of the immersion of a magnet in a plating solution, but it is also possible that a low cathode current density of less than 0.01 A/dm$^2$ is applied.

By applying the cathode current density for performing an electrolytic copper plating treatment over a certain period of time as above, the thickness of an oxygen-containing layer formed due to the degeneration of the surface of the magnet at the start of the electrolytic copper plating treatment (a layer present at the interface between the magnet and the film after the formation of an electrolytic copper plating film on the surface of the magnet, which is amorphous and, in the case where the plating solution is alkaline, contains hydroxide of iron as a main component) can be up to 10 nm. It is thus possible to prevent the formation of an electrolytic copper plating film having poor adhesion on the surface of the magnet due to the formation of an oxygen-containing layer having a thickness more than 10 nm. Incidentally, the thickness of the oxygen-containing layer is preferably less than 5 nm, and more preferably less than 3 nm. It is most preferable that no oxygen-containing layer is present.

In addition, it has been found that by applying the cathode current density for performing an electrolytic copper plating treatment over a certain period of time as above, surprisingly, the crystal grain size of the resulting electrolytic copper plating film is coarsened. It is likely that this phenomenon also contributes to the improvement of the adhesion of the film to the surface of the magnet. How an increase in the crystal grain size of a film occurs is not exactly clear but is likely to be as follows. In the case where the displacement deposition of copper occurs on the surface of a magnet, a displacement copper plating film having a fine crystal grain size is formed, and, under the influence of the crystal grain size of the displacement copper plating film, the electrolytic copper plating film that grows on the surface thereof also has a fine crystal grain size. However, when the cathode current density for performing an electrolytic copper plating treatment is gradually applied over a certain period of time, the electrodeposition reaction of $Cu^{2+}$ ions contained in the plating solution proceeds smoothly. As a result, the formation of a displacement copper plating film having a fine crystal grain size on the surface of the magnet is effectively prevented. Meanwhile, an electrolytic copper plating film, which serves as a stepping stone for crystals to grow and coarsen, is effectively formed.

Therefore, according to the present invention, it is possible to produce a rare earth metal-based permanent magnet having an electrolytic copper plating film with excellent adhesion formed on the surface thereof, in which an oxygen-containing layer that is present at the interface between the magnet and the film has a thickness up to 10 nm, and the film has a large average crystal grain size (e.g., 0.5 μm to 3.0 μm).

Incidentally, other conditions of the electrolytic copper plating treatment may be basically the same as the conditions of a usual electrolytic copper plating treatment. However, it is preferable that the plating solution bath temperature is 10° C. to 70° C. This is because when the bath temperature is less than 10° C., the limiting current may significantly decrease, while when it is more than 70° C., a disproportionation reaction is likely to take place between the anode and free copper, mating bath control difficult. The plating method may be rack plating or barrel plating. It is preferable that the electrolytic copper plating treatment is performed for a period of time of 2 minutes to 450 minutes. When the period of time of the treatment is like this, an electrolytic copper plating film with excellent adhesion having a thickness of 2 μm to 20 μm can be easily formed on the surface of the magnet.

The plating solution for an electrolytic copper plating treatment to which the present invention can be applied is not particularly limited as long as it can be used to form an electrolytic copper plating film on the surface of a rare earth metal-based permanent magnet. For example, considering the high corrosion susceptibility of a rare earth metal-based permanent magnet under acidic conditions, the present invention can be applied to a known plating solution adjusted to alkaline (e.g., pH 8 to 14). Specific examples thereof include the plating solution for an electrolytic copper plating treatment described in Patent Document 1, which is adjusted to pH 9.0 to 11.5 and contains at least (1) $Cu^{2+}$ ions: 0.02 mol/L to 0.15 mol/L, (2) an organic phosphoric acid having two or more phosphorus atoms and/or a salt thereof: 0.1 mol/L to 0.5 mol/L, (3) gluconic acid and/or a salt thereof: 0.005 mol/L to 0.5 mol/L, (4) sulfate and/or nitrate: 0.01 mol/L to 5.0 mol/L, and (5) at least one organic carboxylic acid selected from oxalic acid, tartaric acid, citric acid, malonic acid, and malic acid and/or a salt thereof: 0.01 mol/L to 0.5 mol/L, and the plating solution for an electrolytic copper plating treatment described in Patent Document 2, which is adjusted to pH 9.0 to 11.5 and contains at least (1) $Cu^{2+}$ ions: 0.03 mol/L to 0.15 mol/L, (2) a chelating agent whose chelate stability constant with $Cu^{2+}$ ions is 10.0 or more at a pH of 9.0 to 11.5 (HEDP, a salt thereof, etc.) 0.1 mol/L to 0.5 mol/L, and (3) a chelating agent whose chelate stability constant with $Fe^{3+}$ ions is 16.0 or more at a pH of 9.0 to 11.5 (pyrophosphoric acid, a salt thereof, etc.): 0.01 mol/L to 0.5 mol/L. Examples further include commercially available plating solutions for an electrolytic copper plating treatment (e.g., available from Okuno chemical Industries Co., Ltd. under the trade name "Soft Copper").

Incidentally, it is also possible to further form a corrosion resistant film such as a metal plating film, for example, on the surface of an electrolytic copper plating film formed on the surface of a rare earth metal-based permanent magnet by the method of the present invention. Examples of rare earth metal-based permanent magnets to which the method of the present invention is applied include R—Fe—B based permanent magnets.

EXAMPLES

Hereinafter, the invention will be described in further detail with reference to examples, but it should be understood that the present invention is not limited to the following description. The following examples and comparative examples were performed using a test piece with a size of 1.0 mm (magnetization direction)×6.0 mm×34 mm (hereinafter referred to as "magnet test piece") cut from a sintered magnet body having a composition of 15Nd-78Fe-7B (at %) produced as follows. As starting materials, electrolytic iron, ferroboron, and Nd as R were blended into the required magnet composition. The mixture was melted and casted, followed by coarse crushing and then fine grinding by a mechanical crushing method to give a fine powder with a gain size of 3 μm to 10 μm. The powder was shaped in a magnetic field of 10 kOe and then sintered at 1100° C.×1 hour in an argon atmosphere. Subsequent the obtained sintered compact was subjected to an aging treatment at 600° C.×2 hours to produce the sintered magnet body.

Example 1

"Soft Copper" (trade name) available from Okuno Chemical Industries Co., Ltd. was used as a commercially available plating solution for an electrolytic copper plating treatment. The pH was adjusted to 11.5 with potassium hydroxide, and then an electrolytic copper plating treatment was performed by a barrel method for 30 minutes at a plating solution bath temperature of 42° C. and a cathode current density of 0.3 A/dm$^2$. Incidentally, the magnet test piece to be treated had been surface-activated with a 0.1 mol/L nitric acid solution, then washed with water, and subjected to the experiment with water remaining on the surface thereof. The cathode current density was applied as follows. After a barrel housing the magnet test piece was immersed in the plating solution, the supply of current was linearly increased using a rectifier to reach the set value in 30 seconds (cathode current density increase rate: 0.01 A/(dm$^2$×sec)). The electrolytic copper plating film formed on the surface of the magnet test piece under the above conditions had a thickness of about 4.0 μm. The adhesion of the electrolytic copper plating film was so excellent that the film was not peeled even when subjected to a cross-cut peel test in accordance with JIS K 5400 (see FIG. 1). The magnet test piece having the electrolytic copper plating film formed on the surface thereof was subjected to a cross-sectional analysis using a transmission electron microscope (TEM: HF-2100 manufactured by Hitachi High-Technologies Corporation, the same applies hereinafter). The results are shown in FIG. 2 and FIG. 3. As is obvious from FIG. 2, the electrolytic copper plating film had an extremely large crystal grain size (the grain size of crystal grains), and most of the grains had a size of 0.5 μm to 2.0 μm (the average crystal grain size was about 1.2 μm: the average value of the measured values of the grain size of crystal grains intersecting a straight line approximately parallel to the surface of the magnet test piece as observed in arbitrary field of view near the center of the thickness, the same applies hereinafter). In addition, as is obvious from FIG. 3, an amorphous oxygen-containing layer (confirmed to contain hydroxide of iron as a main component by a separate analysis using a TEM electron line image and an energy dispersive X-ray analyzer (EDX: VOYAGER III manufactured KORAN Instruments, Inc.), the same applies hereinafter) was present at the interface between the magnet test piece and the film. However, the layer was extremely thin, and the thickness was about 2 nm to 3 nm.

Example 2

An electrolytic copper plating film was formed on the surface of a magnet test piece under the same conditions as in Example 1, except that the cathode current density was applied as follows: after a barrel housing the magnet test piece was immersed in the plating solution, the supply of current was linearly increased using a rectifier to reach the set value in 10 seconds (cathode current density increase rate: 0.03 A/(dm$^2$×sec)). The formed electrolytic copper plating film had a thickness of about 4.2 μm. The adhesion of the electrolytic copper plating film was so excellent that the film was not peeled even when subjected to a cross-cut peel test in accordance with JIS K 5400. The magnet test piece having the electrolytic copper plating film formed on the surface thereof was subjected to a cross-sectional analysis using TEM. As a result, the electrolytic copper plating film had an extremely large crystal grain size, and most of the grains had a size of 0.4 μm to 1.8 μm (the average crystal grain size was about 1.1 μm). In addition, although an amorphous oxygen-containing layer was present at the interface between the magnet test piece and the film, the layer was extremely thin, and the thickness was about 2 nm to 3 nm.

Example 3

An electrolytic copper plating film was formed on the surface of a magnet test piece under the same conditions as in Example 1, except that the cathode current density was applied as follows: after a barrel housing the magnet test piece was immersed in the plating solution, the supply of current was linearly increased using a rectifier to reach the set value in 180 seconds (cathode current density increase rate: 0.002 A/(dm$^2$×sec)). The formed electrolytic copper plating film had a thickness of about 4.1 μm. The adhesion of the electrolytic copper plating film was so excellent that the film was not peeled even when subjected to a cross-cut peel test in accordance with JIS K 5400. The magnet test piece having the electrolytic copper plating film formed on the surface thereof was subjected to a cross-sectional analysis using TEM. As a result, the electrolytic copper plating film had an extremely large crystal drain size, and most of the grains had a size of 0.6 μm to 2.3 μm (the average crystal grain size was about 1.3 μm). In addition, although an amorphous oxygen-containing layer was present at the interface between the magnet test piece and the film, the layer was extremely thin, and the thickness was about 3 nm to 4 nm.

Example 4

An electrolytic copper plating film was formed on the surface of a magnet test piece under the same conditions as in Example 1, except that the cathode current density was 0.1 A/dm$^2$, and that the electrolytic copper plating treatment was performed for 90 minutes (cathode current density increase rate: 0.003 A/(dm$^2$×sec)). The formed electrolytic copper plating film had a thickness of about 4.0 μm. The adhesion of the electrolytic copper plating film was so excellent that the film was not peeled even when subjected to a cross-cut peel test in accordance with JIB K 5400. The magnet test piece having the electrolytic copper plating film formed on the surface thereof was subjected to a cross-sectional analysis using TEM. As a result, the electrolytic copper plating film had an extremely large crystal grain size, and most of the grains had a size of 0.5 μm to 2.2 μm (the average crystal grain size was about 1.4 μm). In addition, although an amorphous oxygen-containing layer was present at the interface between the magnet test piece and the film, the layer was extremely thin, and the thickness was about 3 nm to 4 nm.

Example 5

An electrolytic copper plating film was formed on the surface of a magnet test piece under the same conditions as in Example 1, except that the cathode current density was 3.0 A/dm$^2$, and that the electrolytic copper plating treatment was performed for 5 minutes (cathode current density increase rate: 0.1 A/(dm$^2$×sec)). The formed electrolytic copper plating film had a thickness of about 6.1 μm. The adhesion of the electrolytic copper plating films was so excellent that the film was not peeled even when subjected to a cross-cut peel test in accordance with JIS K 5400. The magnet test piece having the electrolytic copper plating film formed on the surface thereof was subjected to a cross-sectional analysis using TEM. As a result, the electrolytic copper plating film had an extremely large crystal grain size, and most of the grains had a size of 0.7 μm to 2.5 μm (the average crystal drain size was about 1.5 μm). In addition, although an amorphous oxygen-containing layer was present at the interface between the magnet test piece and the film, the layer was extremely thin, and the thickness was about 2 nm to 4 nm.

Comparative Example 1

An electrolytic copper plating film was formed on the surface of a magnet test piece under the same conditions as in Example 1, except that the cathode current density was applied as follows: immediately after a barrel housing the magnet test piece was immersed in the plating solution, current was supplied instantaneously to reach the set value using a rectifier. The formed electrolytic copper plating film had a thickness of about 4.0 μm. The adhesion of the electrolytic copper plating film was so poor that the film was peeled when subjected to a cross-cut peel test in accordance with JIS K 5400 (see FIG. 4). The magnet test piece having the electrolytic copper plating film formed on the surface thereof was subjected to a cross-sectional analysis using TEM. As a result, as is obvious from FIG. 5, the electrolytic copper plating film had an extremely small crystal grain size, and most of the grains had a size of less than 0.5 μm (the average crystal grain size was about 0.3 μm). In addition, as is obvious from FIG. 6, the amorphous oxygen-containing layer present at the interface between the magnet test piece and the film was extremely thick, and the thickness was more than 10 nm. Further, as is obvious from FIG. 7, shedding was observed at the interface between the magnet test piece and the film, which is likely to be attributable to the displacement plating reaction between iron or the like constituting the surface of the magnet test piece and copper.

Comparative Example 2

An electrolytic copper plating film was formed on the surface of a magnet test piece under the same conditions as in Example 1, except that the cathode current density was applied as follows: after a barrel housing the magnet test piece was immersed in the plating solution, the supply of current was linearly increased using a rectifier to reach the set value in 300 seconds (cathode current density increase rate: 0.001 A/(dm$^2$×sec)). As a result, the formed electrolytic copper placing film had already developed significant discoloration at the time of the completion of the plating treatment, showing practical problems (the thickness was not measured). The adhesion of the electrolytic copper plating film was so poor that the film was peeled when subjected to a cross-cat peel test in accordance with JIS K 5400. The magnet test piece having the electrolytic copper plating film formed on the surface thereof was subjected to a cross-sectional analysis using TEM. As a result, as is obvious from FIG. 8, the electrolytic copper plating film had an extremely small crystal grain size, and most of the grains had a size of less than 0.5 μm (the average crystal grain size was about 0.3 μm). In addition, as is obvious from FIG. 9, the amorphous oxygen-containing layer present at the interface between the magnet test piece and the film was extremely thick, and the thickness was more than 10 nm. Further, as is obvious from FIG. 10, shedding was observed at the interface between the magnet test piece and the film, which is likely to be attributable to the displacement plating reaction between iron or the like constituting the surface of the magnet test piece and copper.

Example 6

An electrolytic copper plating film was formed on the surface of a magnet test piece under the same conditions as in Example 1, except that the electrolytic copper plating treatment was performed at a plating solution bath temperature of 60° C. using a plating solution for an electrolytic copper plating treatment described in Patent Document 1 adjusted to pH 11.0 with sodium hydroxide and containing (1) copper sulfate pentahydrate: 0.06 mol/L, (2) HEDP: 0.15 mol/L, (3) sodium gluconate: 0.01 mol/L, (4) sodium sulfate: 0.1 mol/L, and (5) sodium tartrate: 0.1 mol/L. The formed electrolytic copper plating film had a thickness of about: 4.2 μm. The electrolytic copper plating film had adhesion causing no practical problem a cross-cut peel test in accordance with JIS K 5400.

Example 7

An electrolytic copper plating film was formed on the surface of a magnet test piece under the same conditions as in Example 1, except that the electrolytic copper plating treatment was performed at a plating solution bath temperature of 60° C. using a plating solution for an electrolytic copper plating treatment described in Patent Document 2 adjusted to pH 10.0 with sodium hydroxide and containing (1) copper sulfate pentahydrate: 0.06 mol/L, (2) HEDP: 0.15 mol/L, and (3) potassium pyrophosphate: 0.2 mol/L. The formed electrolytic copper plating film had a thickness of about 4.1 μm. The electrolytic copper plating film had adhesion causing no practical problem in a cross-cut peel test in accordance with JIS K 5400.

INDUSTRIAL APPLICABILITY

The present invention makes it possible to provide a novel method for forming an electrolytic copper plating film having excellent adhesion on the surface of a rare earth metal-based permanent magnet. In this respect, the present invention is industrially applicable.

The invention claimed is:

1. A method for forming an electrolytic copper plating film on the surface of a rare earth metal-based permanent magnet, comprising the steps of:

immersing the rare earth metal-based permanent magnet in a plating solution containing $Cu^{2+}$ ions, applying an increasing cathode current density in a range of 0.05 $A/dm^2$ to 4.0 $A/dm^2$ to the rare earth metal-based permanent magnet over 10 seconds to 180 seconds, wherein a cathode current density increase rate for applying the increasing cathode current density is 0.002 $A/(dm^2 \times sec)$ to 0.4 $A/(dm^2 \times sec)$, until a predetermined value of current density is reached, and then performing an electrolytic copper plating treatment at the predetermined value of current density.

2. The method according to claim 1, characterized in that the step for performing an electrolytic copper plating treatment is performed for a period of time of 2 minutes to 450 minutes.

3. The method according to claim 1, characterized in that the plating solution is alkaline.

4. A method for improving the adhesion of an electrolytic copper plating film formed on the surface of a rare earth metal-based permanent magnet, comprising the steps of:

immersing the rare earth metal-based permanent magnet in a plating solution containing $Cu^{2+}$ ions, applying an increasing cathode current density in a range of 0.05 $A/dm^2$ to 4.0 $A/dm^2$ to the rare earth metal-based permanent magnet over 10 seconds to 180 seconds, wherein a cathode current density increase rate for applying the increasing cathode current density is 0.002 $A/(dm^2 \times sec)$ to 0.4 $A/(dm^2 \times sec)$, until a predetermined value of current density is reached, and then performing an electrolytic copper plating treatment at the predetermined value of current density.

* * * * *